US006926098B2

(12) United States Patent
Peter

(10) Patent No.: US 6,926,098 B2
(45) Date of Patent: Aug. 9, 2005

(54) INSULATIVE GAP SUB ASSEMBLY AND METHODS

(75) Inventor: Andreas Peter, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 121 days.

(21) Appl. No.: 10/308,560

(22) Filed: Dec. 2, 2002

(65) Prior Publication Data

US 2004/0104047 A1 Jun. 3, 2004

(51) Int. Cl.[7] ..... E21B 47/12
(52) U.S. Cl. ..... 175/40; 175/320; 340/854.6
(58) Field of Search ..... 175/40, 320; 166/65.1; 340/854.6, 854.4; 285/48, 50, 53

(56) References Cited

U.S. PATENT DOCUMENTS

| | | | | |
|---|---|---|---|---|
| 2,368,777 A | * | 2/1945 | Price | 166/304 |
| 3,259,562 A | | 7/1966 | Salt et al. | 204/181 |
| 4,348,672 A | * | 9/1982 | Givler | 340/854.8 |
| 4,496,174 A | | 1/1985 | McDonald et al. | 285/53 |
| 5,138,313 A | | 8/1992 | Barrington | |
| 5,163,714 A | | 11/1992 | Issenmann | |
| 5,394,141 A | | 2/1995 | Soulier | |
| 6,158,532 A | | 12/2000 | Logan et al. | |
| 6,218,959 B1 | * | 4/2001 | Smith | 340/853.7 |
| 6,515,592 B1 | * | 2/2003 | Babour et al. | 340/854.4 |

FOREIGN PATENT DOCUMENTS

| | | | |
|---|---|---|---|
| EP | 0 964 134 | 12/2000 | E21B/47/12 |
| FR | 2 618 912 | 3/1989 | G01V/3/30 |
| GB | 2 364 724 | 2/2002 | E21B/47/12 |

* cited by examiner

*Primary Examiner*—David Bagnell
*Assistant Examiner*—K. Thompson
(74) *Attorney, Agent, or Firm*—Madan, Mossman & Sriram, P.C.

(57) ABSTRACT

Devices and methods for incorporating a gap sub assembly into a drill string to electrically isolate portions of a transmitter assembly within, for example, an MWD tool located within the drill string. The gap sub assembly incorporates upper and lower subs having an insulated interconnection. A central conductor assembly is axially disposed within the lower sub and does not extend through the length of the gap sub. The central conductor assembly is used to transmit electrical power and data across the gap sub assembly between the upper portions of the drill string and transmitter components housed within the MWD tool disposed below the gap sub assembly.

19 Claims, 4 Drawing Sheets

INSULATIVE GAP SUB ASSEMBLY AND METHODS

BACKGROUND OF THE INVENTION

1. Field of the Invention

The invention relates generally to devices and methods for electrically insulating and isolating an electromagnetic telemetry system within a drill string. In particular aspects, the invention relates to improved systems for providing an insulative gap assembly within a drill string.

2. Description of the Related Art

Electromagnetic transmitters are used within petrochemical wellbores for the transmission of borehole data and other information to the surface. Such transmitters are often used in measurement-while-drilling (MWD) arrangements wherein downhole conditions are sensed and transmitted to the surface for operators to make adjustments to the drilling operation. An electromagnetic transmitter is formed by electrically separating two metallic drill collars, or subs, by an insulated, tubular "gap sub." An electrical conductor is disposed through the axial center of the gap sub to permit electrical signals to be alternately provided to the separated drill collars. The separated collars then function as the two poles of a dipole antenna within the earth for sending information wirelessly to a receiver located at the surface of the well.

The use of conventional gap subs has been problematic. Conventional gap sub assemblies have been provided by insulated or non-conductive members that are disposed between two conductive portions in a drill string. The gap sub provides electrical isolation of the drill string portions. In this type of arrangement, a longitudinal conductor must be mechanically supported within and along the length of the gap sub. Depending upon the length of the gap sub, the conductor may have to be more than ten feet in length. Such an arrangement is prone to failure, particularly during drilling when abrasive mud is flowed down through the drill string. Additionally, there are times when the length of the gap sub must be changed in order to alter the characteristic of the transmitter antenna. As a result, the conductor must be exchanged for one of different length as well. This is time consuming and allows for installation errors.

The use of gap subs for electrical isolation is also known. U.S. Pat. No. 5,138,313 issued to Barrington, for example, discloses an electrically insulative gap sub assembly wherein the outer surface of a drill pipe joint is covered by several molded "gap blocks" of insulative material. This technique is expensive and can be complex in construction. In addition, it is prone to damage within the wellbore.

U.S. Pat. No. 4,348,672 issued to Givler describes an insulated drill collar gap sub assembly that is used with a particular toroidal-coupled telemetry system. An insulated gap is formed between a pair of annular sub members by forming a gap between them and filling the gap with a dielectric material. To interconnect the gap sub within the drill string, adjoining sub members are essentially keyed to one another using hexagonal keying. In an alternative version of the device, subs are connected using an axially extending member that resides within an axially extending recess. Pins are used to lock the two subs together, and a dielectric material is disposed in a gap between them. In each case, axial bearing assemblies are necessary to help transmit force through the gap sub. A significant disadvantage to this type of arrangement is the requirement for special tooling to form the various keys or extensions and recesses to mechanically lock the components together. Further, such components would be incompatible with standard drill pipe threaded connections.

There is a need to provide improved methods and devices for integrating a telemetry system into a drill string. It would be an improvement over the prior art to provide simpler construction and cost savings over previous insulative sub constructions. The present invention addresses the problems of the prior art.

SUMMARY OF THE INVENTION

The invention provides devices and methods for incorporating a gap sub assembly into a drill string to electrically isolate portions of a transmitter assembly within, for example, an MWD tool located within the drill string. The gap sub assembly incorporates upper and lower tubular members having an insulated interconnection. In a preferred embodiment, the gap sub assembly incorporates standard threaded end connections having a non-conductive coating thereupon.

A central conductor assembly is incorporated into the insulated interconnection and used to receive electrical signals from an MWD device and transmit the signals alternately between the upper and lower poles of the antenna transmitter. The central conductor assembly is retained largely within the lower sub and does not extend along the length of the insulated gap sub. During operation of the MWD device, signals are alternately transmitted to each of the poles of the antenna transmitter so that information may be transmitted to a surface receiver.

The methods and devices of the present invention include simplicity and lower cost. The methods and devices of the present invention eliminate the need for a conductive element to be disposed within the gap sub between the two dipole elements. The present invention instead transmits electrical signals to the upper drill string elements through the body of the gap sub itself. If a gap sub of different length is subsequently required, this may be accomplished by merely replacing the gap sub itself without the need to replace the central conductor assembly with one of a different length.

DETAILED DESCRIPTION OF THE PREFERRED EMBODIMENTS

Figure 1:
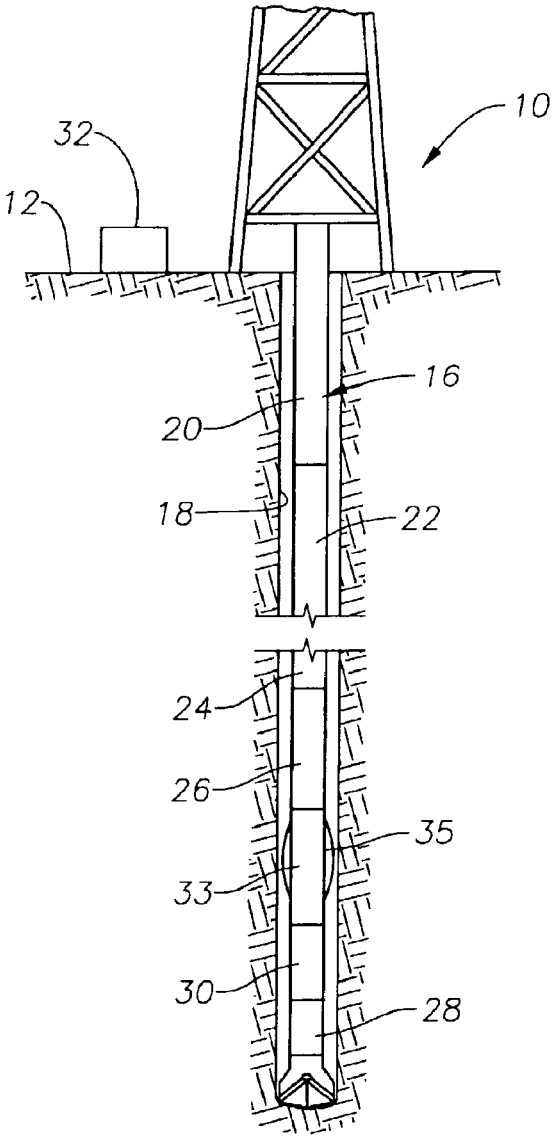
FIG. 1 is a side, cross-sectional view of a portion of an exemplary drill string that incorporates an insulative gap sub assembly constructed in accordance with the present invention.

Referring first to FIG. 1, there is shown an exemplary hydrocarbon well 10 that is being drilled from the surface 12 downward through an earth formation 14. A drill string 16 is shown disposed within the wellbore 18 of the well 10 and is composed of a number of interconnected drill pipe sections 20, 22, 24, 26 that support a bottom hole assembly (BHA) 28. As is well known, the BHA 28 includes a drill bit that cuts through the earth formation 14 during drilling operations. Although only a few drill pipe sections are shown in FIG. 1, it should be understood that in practice there are often a large number of such sections. Each of the drill pipe sections 20, 22, 24, 26 is a conductive tubular member, and they are interconnected to one another using standard threaded connections of a type well known in the art.

In the drill string 16 depicted in FIG. 1, an exemplary MWD tool 30 is shown that is located just above the BHA 28. The MWD tool 30 is operable to transmit downhole data to a receiver, schematically shown at 32, that is located on the surface 12.

Figure 2:
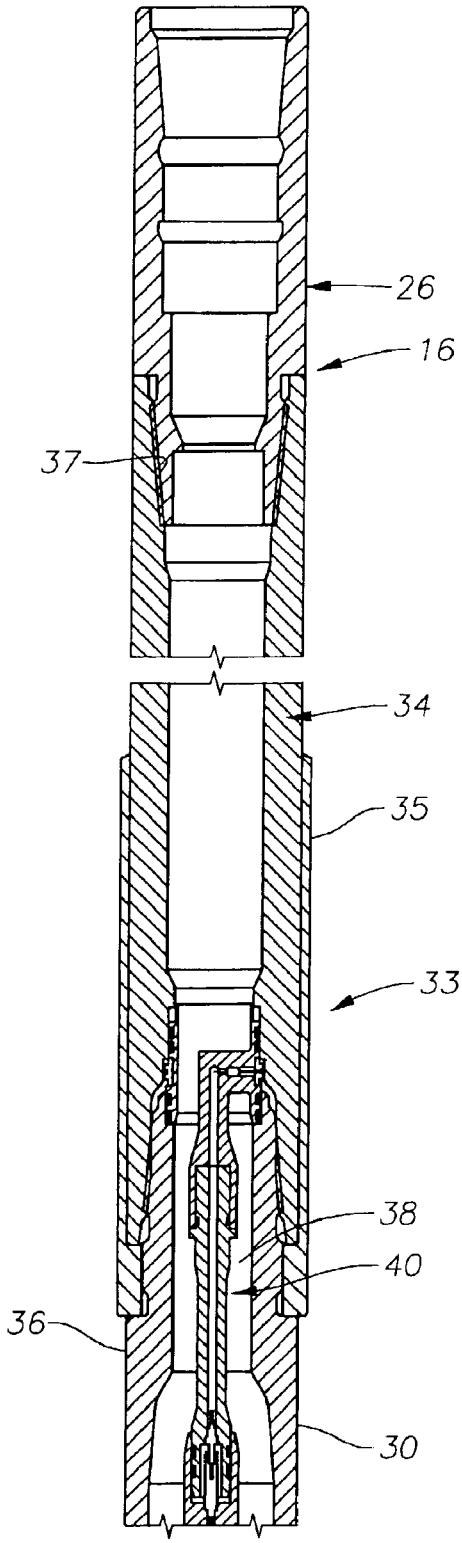
FIG. 2 is a side, cross-sectional view of a lower portion of the drill string shown in FIG. 1.

FIG. 2 provides a more detailed view of lower portions of the drill string 16, including the upper portion of the MWD tool 30. The lower portion (not shown) of the MWD tool 30 includes a transmitter (not shown), of a type known in the art, which is used to transmit received data to the receiver 32. Suitable MWD tools for use as the tool 30 include the NaviTrak® I and Navitrak® II, which are available commercially from Baker Hughes INTEQ. As both FIGS. 1 and 2 illustrate, a gap sub assembly 33 that includes upper and lower subs 34 and 36, respectively, which separate the MWD tool 30 from the lowest drill pipe section 26. The upper sub 34 is also referred to as a "gap sub." The upper sub 34 is a metallic, conductive member with an insulated coating upon its entire inner and outer radial surfaces and axial ends except upon the upper threads 37 (see FIG. 2), by which the sub 34 is connected to drill string section 26, and as otherwise noted herein. An external stabilizing collar 35 radially surrounds portions of the upper and lower subs 34, 36 and serves to protect the insulated coating on the outer radial surface of the gap sub 34 from being damaged or rubbed off by contact with the wellbore 18. The lower sub 36 defines a borespace 38 within. It is noted that the lower sub 36 may be formed integrally with the outer housing of the MWD tool 30.

Figure 5:
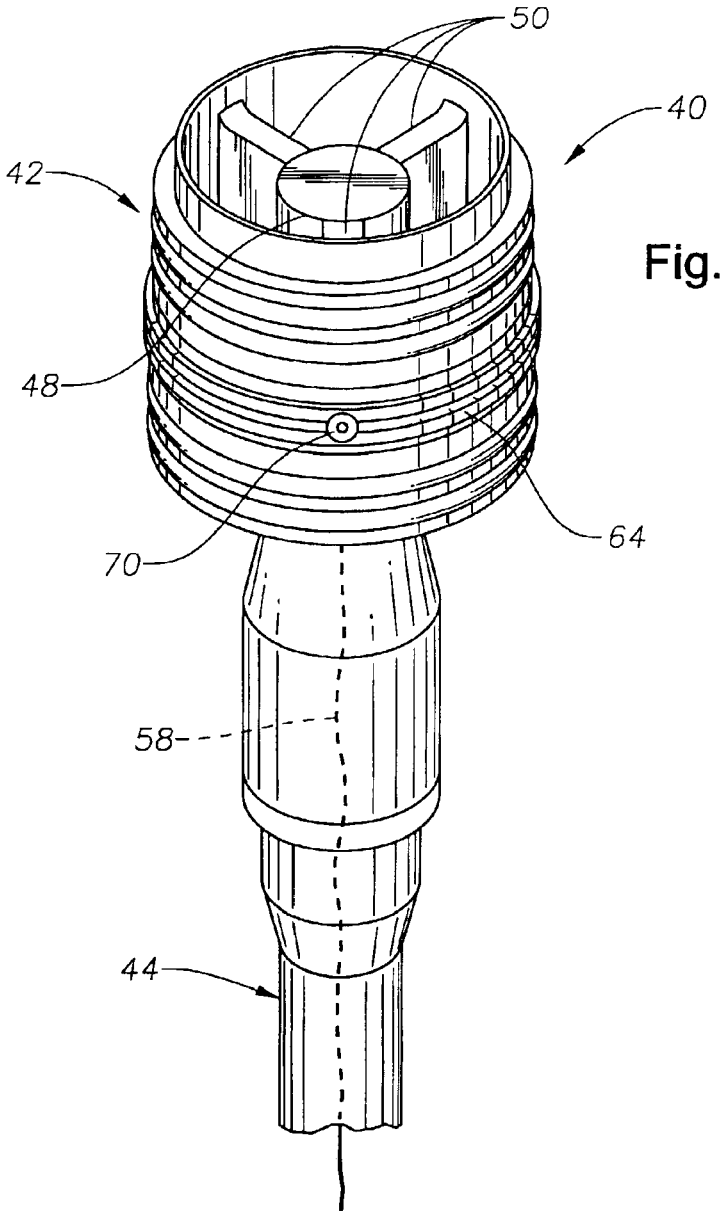
FIG. 5 is an isometric view of portions of an exemplary conductor assembly shown apart from other portions of the gap sub assembly.

A longitudinal conductor assembly 40 extends centrally through the borespace 38 in a spaced relation from the walls of the lower gap sub 36. The structure of the conductor assembly 40 may be better appreciated by reference as well to FIG. 5, which depicts portions of the conductor assembly 40 apart from other components of the gap sub assembly 33. The conductor assembly 40 includes an upper retaining portion 42 and a lower conducting portion 44 that is affixed to the retaining portion 42 by a threaded connection 43. The upper retaining portion 42 features an annular plug member 46 and a central tubular portion 48 that is interconnected to the annular plug member 46 by a plurality of radially-extending spokes 50. The spokes 50 define spaces 51 (visible in FIG. 5) therebetween so as to permit fluids to pass through. The plug member 46 includes an outer radial surface 52 that contains a number of recesses 54 within which O-ring seals 56 reside.

The central tubular portion 48 and the lower conducting portion 44 retain a conductive element 58 that is disposed longitudinally therethrough. The conductive element 58 connects at it lower end (not shown) to signal components housed within the MWD tool 30. Because the details of such connections are well-known, and differ depending upon the specific MWD tool used, these connections will not be described in any detail here. The lower conducting portion 44 of the conductor assembly 40 includes an outer housing 60 that encloses the conductive element 58. Members 42 and 60 are generally insulated from the gap sub 34 by the insulative coating on the interior surface of the gap sub 34 and an insulative coating covering the radially interior surface of the lower sub 36. However, it is noted that the MWD components that are retained within the lower sub 36 are electrically and mechanically connected with the lower sub 36 and, thus the lower sub 36 provides a ground for MWD components.

Figure 6:
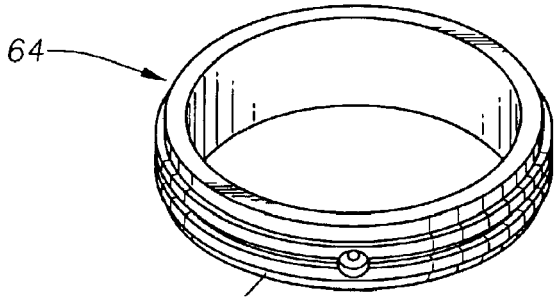
FIG. 6 is an isometric view of an exemplary insulative ring assembly shown apart from other portions of the gap sub assembly.

The outer radial surface 52 of the plug member 46 contains a groove 62, and an insulative ring member 64 resides therein. The insulative ring member 64 is secured against the outer radial surface 52 by an inwardly-biased C-ring or snap ring 66, visible in FIG. 3. The insulative ring member 64 is shown apart from other components in FIG. 6. The insulative ring member 64 formed of an insulative material such as ceramic or a plastic polymer, such as PEEK (PolyEtherEtherKeytone). The insulative ring member maintains electrical isolation between the upper gap sub 34 and the plug member 46. However, a portion of the insulative material from the ring member 64 is removed at gap 68, thereby providing a conductive pathway from the upper gap sub 34 to an electrical contact element 70 that is disposed within the gap 68. If desired, the contact element 70 may be spring biased radially outwardly to ensure good contact with the upper gap sub 34. The contact element 70 is electrically interconnected to the conductive element 58 via a conductive pressure plug 72 which prevents wellbore fluids from entering lateral bore 74 and coming into contact with the conductive element 58. An alignment pin 76 is disposed through the insulative ring member 64 and the spoke 50 to ensure proper alignment of the components.

Figure 3:
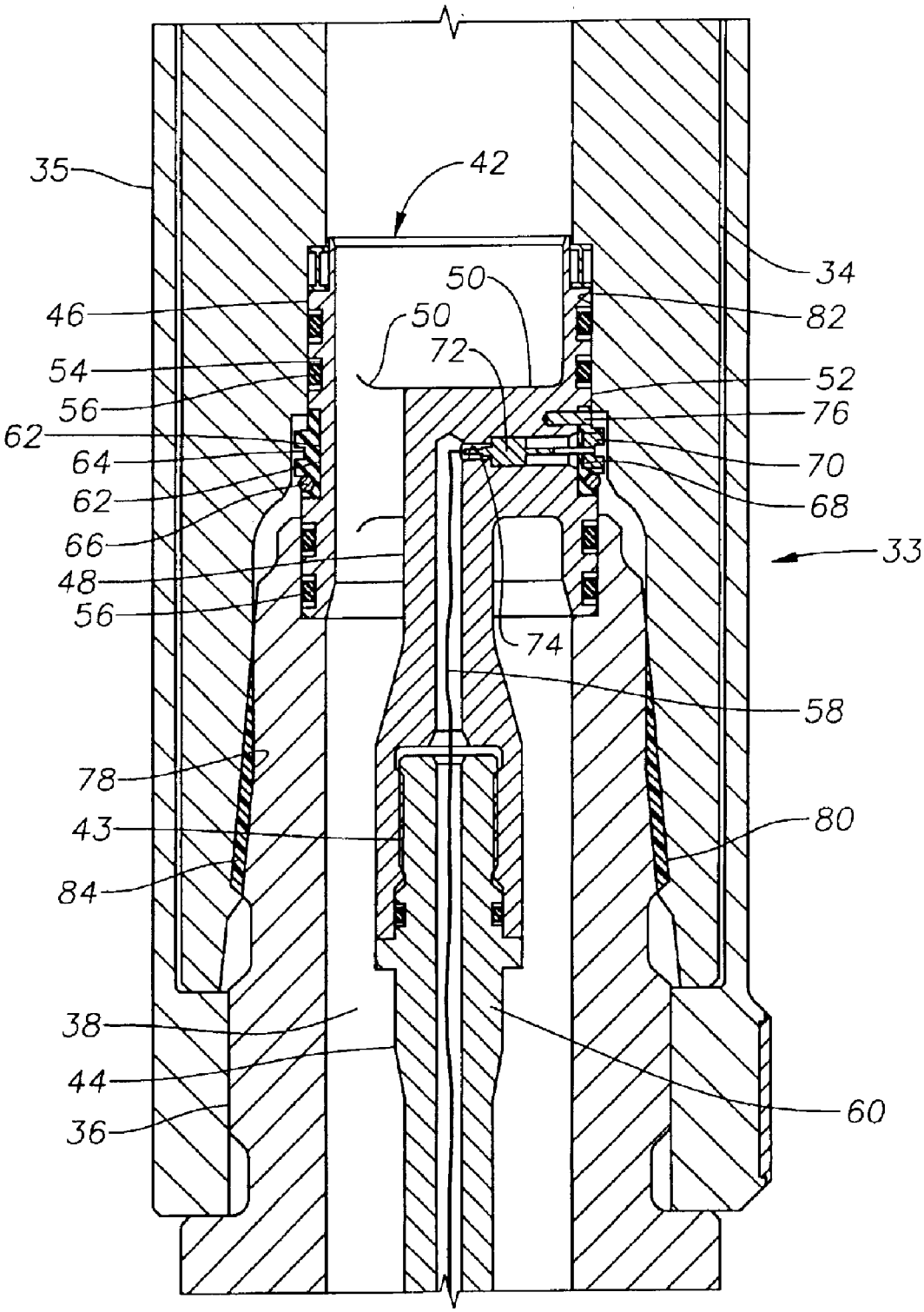
FIGS. 3 and 4 present a closer, side cross-sectional view of portions of the gap sub assembly constructed in accordance with the present invention.
Figure 4:
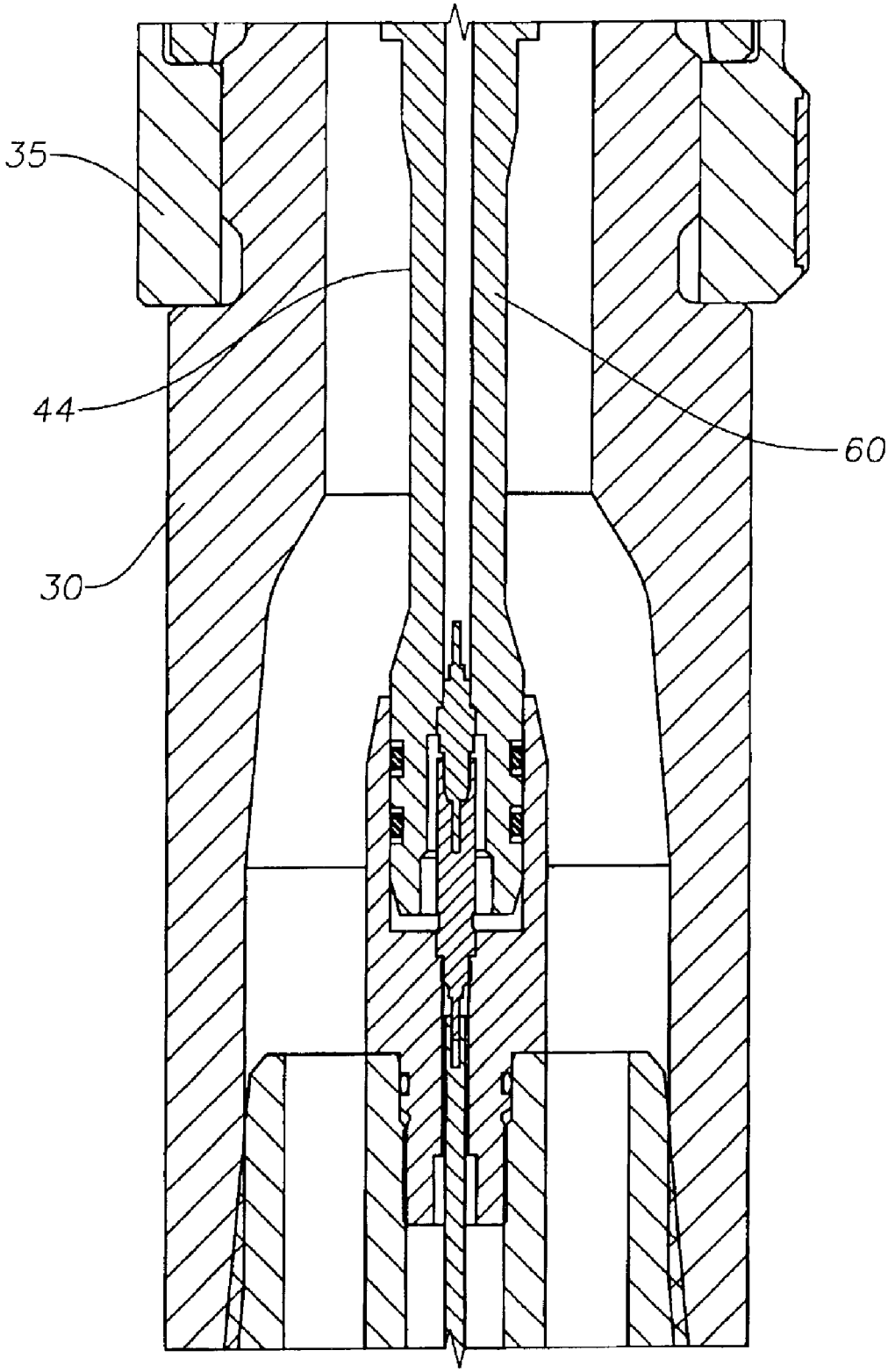

The upper gap sub 34 and sub 36 are provided with a unique insulated interconnection that is preferably formed by disposing a non-conductive material layer between the two components and functions to preclude transmission of electrical signals thereacross. The lower end of the upper gap sub 34 features a box-type threaded connector 78 that is shaped and sized to be complimentary to the pin connector 80 at the upper end of the lower gap sub 36. As best shown in FIG. 3, the upper gap sub 34 also defines a cylindrical recess 82 within its lower end. There is no insulative coating upon the radially interior wall of the recess 82, thereby allowing electrical transmission between the body of the gap sub 34 and the contact element 70. The plug member 46 and insulative ring member 64 reside within the recess 82. When the plug member 46 and ring member 64 are seated within the recess 82 between the two subs 34, 36, an electrical connection is created between the lowest drill pipe section 26 and components housed within the MWD tool 30. In addition, an electrical connection is present between the components housed within the MWD tool 30 and the lower sub 36 that houses these components.

Prior to assembly, one or both of the threaded connectors 78, 80 are coated with an insulative material, shown schematically at 84 to provide electrical isolation between the gap sub 34 and MWD sub 36. Suitable insulative materials for this application include ceramic oxide or a plastic epoxy mix, preferably containing small ceramic particles to transmit compressive forces. Additionally, if the subs 34, 36 are formed of a titanium alloy, titanium oxide may be used as the insulative material. It is currently preferred that the insulative material be applied as a spray coating to a thickness suitable for inhibiting transfer of electricity between the subs 34 and 36.

In operation, the gap sub assembly 33 electrically isolates the MWD tool 30 from the upper drill string pipe sections 20, 22, 24, 26. At the same time, an electrical signal may be passed between the central components housed within the MWD tool 30 and both of the separated poles of the dipole antenna formed within the drill string 16. One pole of this antenna is provided by the lower sub 36, via the ground connection of the MWD components with the lower sub 36. A signal may be transmitted from the MWD components to the upper gap sub 34 and the interconnected remainder of drill string 16, i.e., the second pole of the antenna, via the electrical pathway established by the conductive element 58, pressure plug 72 and contact element 70. The MWD components may be operated to produce a signal that may be transmitted by this antenna and detected by the receiver 32 at the surface 12.

The gap sub assembly 33 of the present invention is advantageous in that it is inexpensive to employ and the components involved are simple to construct. No resins or specialized tools are needed to construct the gap sub assembly 33. In addition, the components involved are highly resistant to damage from downhole pressures, temperatures and physical hazards.

In addition, if it is necessary to change the gap sub 34 out for a gap sub that is of a different length, it is not necessary to replace the conductor assembly 40. The conductor assembly 40 will transmit signals to both poles of the antennae arrangement regardless of the length of gap sub 34 that is used. Additionally, the characteristics of the antenna signal provided may be altered merely by changing out the gap sub 34 for a gap sub of a different length because signals sent to the gap sub 34 are propagated along the length of the housing rather than along a conductor retained within the sub.

Those of skill in the art will recognize that numerous modifications and changes may be made to the exemplary designs and embodiments described herein and that the invention is limited only by the claims that follow and any equivalents thereof.

What is claimed is:

1. A gap sub assembly for use within a drill string to transmit data sensed by a measurement-while-drilling tool to an external receiver, the gap sub assembly comprising:

a tubular upper gap sub defining an axial borespace within;

a tubular lower sub defining an axial borespace within;

the upper and lower subs being interconnected by an insulated connection to preclude transmission of an electrical signal between the upper and lower subs, the insulated connection being in an area sealed from the borespaces of the upper and lower gap subs;

an electrical conductor assembly retained within the insulated connection in electrical contact with the upper gap sub within the sealed area for transmitting en electrical signal from a measurement-while-drilling tool to the upper gap sub and to the lower sub, the electrical conductor assembly comprising:

a contact member to contact a portion of the upper gap sub; and a pressure plug in electrical contact with the contact member, the pressure plug shaped and sized to prevent entrance of fluids into a non-conductive housing.

2. The gap sub assembly of claim 1 wherein the electrical conductor assembly further comprises:

a central conductor that is disposed within the axial borespace of the lower sub; and a retaining portion having an annular plug member that resides within a recess.

3. The gap sub assembly of claim 2 wherein the central conductor and the annular plug member are interconnected by a plurality of radial spokes.

4. The gap sub assembly of claim 2 wherein the electrical conductor assembly further comprises an insulative ring member to reside within the recess and surround the annular plug member.

5. The gap sub assembly of claim 4 wherein the insulative ring member comprises an annular ring portion formed of electrically non-conductive material and a non-annular conductive portion that permits transmission of an electrical signal between the upper gap sub and the annular plug member.

6. The gap sub assembly of claim 1 wherein the insulated connection is provided by an insulated threaded connection.

7. The gap sub assembly of claim 6 wherein the insulated threaded connection comprises an insulative material that is applied to the threads of the threaded connection.

8. The gap sub assembly of claim 7 wherein the insulative material comprises ceramic oxide.

9. The gap sub assembly of claim 7 wherein the insulative material comprises a polymer.

10. The gap sub assembly of claim 9 wherein the polymer contains ceramic particles for transmission of compressive forces.

11. The gap sub assembly of claim 7 wherein the insulative material comprises titanium oxide.

12. A gap sub assembly for use within a drill string to transmit data sensed by a measurement-while-drilling tool to an external receiver, the gap sub assembly comprising:

an upper gap sub defining an axial borespace within;

a tubular lower sub defining an axial borespace within;

the upper and lower subs being interconnected by an insulated connection to preclude transmission of an electrical signal between the upper and lower subs;

the insulated-connection further-defining an interior recess to retain an electrical conductor assembly;

an electrical conductor assembly retained within the insulated connection for transmitting an electrical signal from a measurement-while-drilling tool contained radially within the drill string to the upper gap sub and to the lower sub, the electrical conductor assembly comprising:

a retaining plug portion that is retained within the interior recess; and an insulative ring member is disposed between the retaining plug portion and the recess, the insulative ring member having an annular non-conductive portion comprised of a non-conductive material and a conductive portion that provides a conductive pathway across a portion of the ring member.

13. The gap sub assembly of claim 12 wherein the insulated connection comprises a threaded connection wherein an insulative material has been applied to threads of the threaded connection.

14. The gap sub assembly of claim 12 wherein the electrical conductor assembly further comprises a non-conductive housing that encloses a conductive pathway.

15. The gap sub assembly of claim 14 wherein the conductive pathway further comprises:

a contact member to contact a portion of the upper gap sub;

a pressure plug in electrical contact with the contact member, the plug shaped and sized to prevent entrance of fluids into the non-conductive housing;

a conductor extending from the pressure plug to said measurement-while-drilling tool; and a ground connection that extends between the measurement-while-drilling tool and the lower sub.

16. A method of providing an insulative gap between a measurement-while-drilling tool and drill string sections within a drill string while allowing an electrical signal to be transmitted between the drill string sections and components housed within the measurement-while-drilling tool, the method comprising:

securing a gap sub assembly between the measurement-while-drilling tool and at least one drill string section, the gap sub assembly having upper and lower subs that are interconnected with one another using an insulated threaded connection;

providing an electrical interconnection between the upper and lower gap subs in a sealed area between the upper and lower gap subs;

disposing an electrical conductor assembly within the gap sub assembly, the conductor assembly having a conductive element to provide an electrical connection between a drill string section and components housed within the measurement-while-drilling tool and contacting the upper gap sub with a contact member in the sealed area that extends from the conductive element through a pressure plug that prevents entrance of fluids toward the conductive element.

17. The method of claim 16 wherein the step of disposing an electrical conductor assembly within the gap sub assembly comprises seating an annular plug portion of the conductor assembly within a recess defined within the gap sub assembly and disposing the remainder of the conductor assembly in a longitudinal spaced relation from the walls of the gap sub assembly.

18. The method of claim 17 wherein the step of disposing an electrical conductor assembly within the gap sub assembly further comprises disposing an insulative ring member between the recess and the annular plug portion.

19. The method of claim 16 wherein the step of contacting the upper gap sub with a contact member comprises blasing the contact member radially outwardly.

* * * * *